United States Patent [19]

Bechtel

[11] 4,409,761

[45] Oct. 18, 1983

[54] ROOF CONSTRUCTION SYSTEM HOLDING ROOF MEMBRANES IN PLACE BY SUCTION FORCES

[76] Inventor: Thomas J. Bechtel, 18737 T.R. 133, Kenton, Ohio 43326

[21] Appl. No.: 255,067

[22] Filed: Apr. 3, 1981

[51] Int. Cl.[3] ..... E04F 17/04

[52] U.S. Cl. ..... 52/1; 52/199; 98/34

[58] Field of Search ..... 52/1, 199; 98/34

[56] References Cited

U.S. PATENT DOCUMENTS

| | | | |
|---|---|---|---|
| 1,451,884 | 4/1923 | Moen | 98/34 |
| 1,965,158 | 7/1934 | Rogliano | 98/34 |
| 4,223,486 | 9/1980 | Kelly | 52/1 |

FOREIGN PATENT DOCUMENTS

| | | | |
|---|---|---|---|
| 2060500 | 6/1972 | Fed. Rep. of Germany | 52/199 |
| 2408794 | 7/1979 | France | 52/199 |

*Primary Examiner*—Alfred C. Perham
*Attorney, Agent, or Firm*—John L. Gray

[57] ABSTRACT

A roof construction system wherein loosely-laid membranes on the top of a roof are held in place on the roof by suction forces when the wind blows, the suction forces varying directly in proportion to the wind velocity which would otherwise tend to lift the membrane so that frontal pressure and drag could dislodge or damage the roofing.

1 Claim, 2 Drawing Figures

ROOF CONSTRUCTION SYSTEM HOLDING ROOF MEMBRANES IN PLACE BY SUCTION FORCES

BACKGROUND OF THE INVENTION

Increasing use of sheets of waterproof membrane, usually made of a plastic or rubber material, has created problems in attaching these sheets of membrane material to the upper surface of the roof. One method employed is to glue the entire sheet to the roof or to the insulation which has been previously placed on the roof. The cost of doing this adds considerable expense to the construction. Another method that is employed is mechanically to fasten blocks or disk to the roof and then glue the sheet to the mechanically fastened blocks or disk. Again, this can result in weak points involving leaks and is an expensive procedure. Another approach is merely to attach the sheets to the periphery of the roof and lay ballast consisting of small stones on the roof. In large span industrial applications this creates a structural problem since the ballast weighs one-half ton per 100 square feet and also the ballast is reflective so that there are no solar heat advantages possible.

If there were no wind, the membrane could merely be laid on the roof, perhaps sealed around the edges, and no problems would arise. However, when the wind blows over the roof, it will cause the membrane to rise up because of the negative pressure created above the roof by the wind blowing and also as a result of the effect of vortexes formed from other buildings in the area and, as a result, frontal pressure and wind drag can stretch or dislodge the membrane causing failure and leaks in the roof.

One approach to solve this problem is shown in U.S. Pat. No. 4,223,486, Kelly, which provides a plurality of one-way or duckbilled valves which are connected between the membrane and the support on which the membrane is placed so that when a negative pressure is created above the membrane, the presence of the exhaust valve will tend to equalize the pressure, and thus prevent uplift of the loosely-laid membrane. While this system has merit, all it does is equalize the pressure above and below the membrane but does not create any positive force to hold the membrane down and in position against the roof surface as the wind velocity increases.

SUMMARY OF THE INVENTION

Applicant's roof construction system involves the use of one or more fans which are positioned on the roof so that they will have their inlet between the loose membrane and the roof surface, the fan being actuated by the wind and creating a suction force underneath the membrane so as to result in a higher pressure above the membrane than under the membrane. This pressure differential increases as the wind velocity increases since the fan suction is increased as the wind velocity increases.

It is therefore an object of this invention to provide a roof construction system, on a flat roof or on an inclined roof, which permits the use of a loosely-laid membrane material in conjunction with a positive displacement fan which will create a partial vacuum between the membrane and the roof surface so as to hold the membrane down in a stable position on the roof and wherein the suction pressure created by the fan will increase in proportion to the velocity of the wind attempting to lift and drag the membrane from the roof.

It is a further object of this invention to provide such a roof construction system which is relatively inexpensive and is easy to install.

Additional objects and advantages of the present invention will become more readily apparent to those skilled in the art when the following general statements and descriptions are read in the light of the appended drawings.

DETAILED DESCRIPTION OF THE INVENTION

Figure 1:
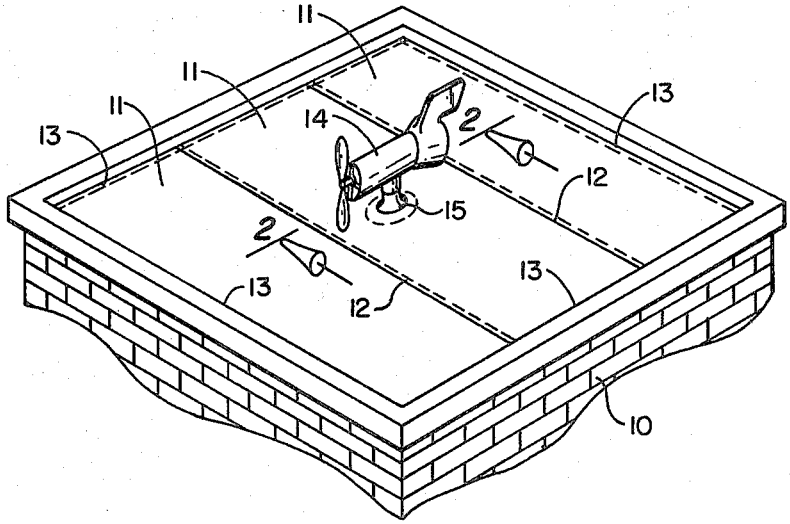
FIG. 1 is a perspective view of a roof on a building showing the membranes laid on the building and a single fan positioned with its suction opening between the membrane and the top of the roof.

Referring now more particularly to FIG. 1, a building structure is shown at 10 which has three waterproof membrane sections 11—11 loosely laid on the top thereof. These membrane sections 11—11 are glued to each other at 12—12 and are also sealed around the periphery of the top edge of the building as shown at 13—13. While the membranes 11—11 vary in size, a common width is approximately 20 feet wide. The fan indicated generally at 14 is placed in the middle of the roof with its suction portion 23 resting on the roof deck with the membrane 11 sealed around the base 15 of the fan and above the lower suction portion.

Figure 2:
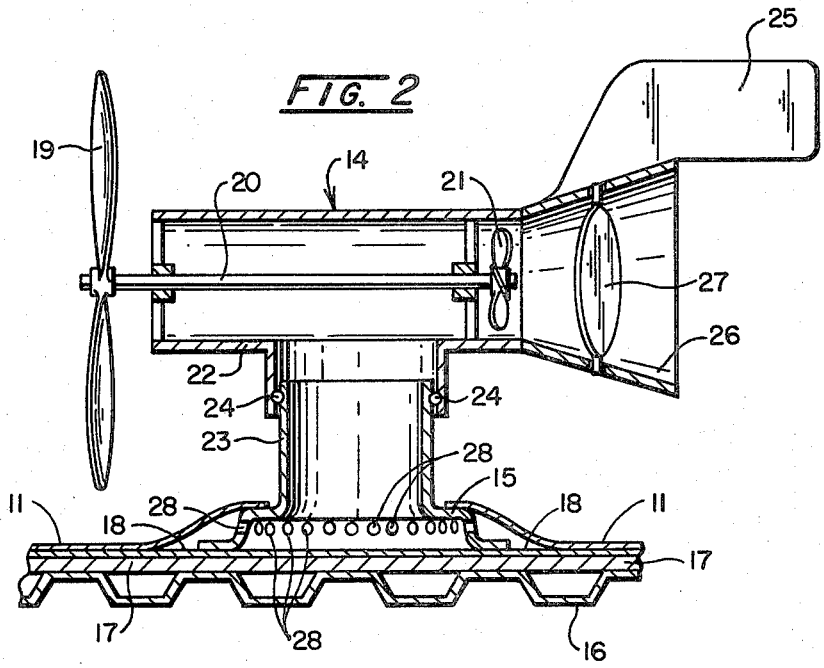
FIG. 2 is a section on lines 2—2 of FIG. 1.

This will be better understood by reference to FIG. 2 which is a sectional view showing a typical roof construction where 16 is a steel deck, 17 is insulation material, 18 is an air separation layer fixedly attached to said insulation material 17, and 11 is the waterproof membrane. Separation layer 18 is used to keep heated air in the building. The fan 14 is provided with a windmill 19 connected by a shaft 20 to the exhaust fan 21. The upper portion 22 of the exhaust fan 14 is rotatably mounted on the lower suction portion 23 on suitable bearings 24—24 and is provided with a vane 25 so that the fan 14 will always face the windmill 19 into the wind. A cone-shaped exhaust portion 26 induces drag to help pull air out of the exhaust fan 14. A flapper valve 27 is provided and the membrane 11 is sealed around the base 15 of the fan 14. Holes 28—28 are provided in the base 15 of the lower portion 23 of the fan 14 to connect the fan 14 to the space between the membrane 11 and the separation layer 18.

In operation, when the wind blows the fan 14 will rotate and face the wind. This causes the windmill 19 to rotate the shaft 20 which in turn rotates the exhaust fan 21 causing any air in the space between the membrane 11 and the separation layer 18 to be drawn through the holes 28—28 up through the lower portion 23 of the exhaust fan 14 and out through the exhaust portion 26 of the fan 14, thus creating a partial vacuum underneath the membrane 11 and holding the membrane 11 down on the roof.

As the velocity of the wind increases it tends to create higher negative pressures above the membrane 11 and thus tends to lift the membrane 11. However, the faster the windmill 19 rotates, the faster the exhaust fan 21 will operate creating a greater partial vacuum between the membrane 11 and the separation layer 18, thus tending to hold the membrane 11 down on the separation layer.

This system may be used on existing roofs and is not limited to flat roofs but may also be used on sloping roofs. The separation layer 18, of course, is optional and the membrane 11 can be laid directly on the insulation 17, if desired.

Depending upon the size of the roof, a plurality of fans 14 may be used, or air channels under the membrane 11 can be created to aid in the evacuation of air in remote sections of the roof.

The flapper valve 27 is provided to prevent a gust of wind from blowing in the exhaust portion 26 of the fan 14, and lifting up the membrane 11 before the fan 14 can rotate to face the windmill 19 into the wind and turn so as to produce a partial vacuum between the membrane 11 and the separation layer 18.

While this invention has been described in its preferred embodiment, it is appreciated that variations therefrom may be made without departing from the true scope and spirit of the invention.

What is claimed is:

1. A roof system comprising a roof surface, a roof membrane positioned on said roof surface, a suction inlet located between said roof membrane and said roof surface, a housing rotatably connected to said suction inlet, a shaft mounted in said housing positioned parallel to the plane of said roof surface, an exhaust fan mounted on said shaft, and means for operating said exhaust fan comprising a windmill attached to said shaft and positioned on the exterior of said housing.

* * * * *